US008671897B2

(12) United States Patent
Geyer et al.

(10) Patent No.: US 8,671,897 B2
(45) Date of Patent: Mar. 18, 2014

(54) TWO-STROKE ENGINE

(75) Inventors: Werner Geyer, Berglen (DE); Mark Reichler, Remshalden (DE); Robert Köhli, Winnenden (DE); Evelyn Kullik, Gerlingen (DE); Helmut Schlessmann, Waiblingen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 225 days.

(21) Appl. No.: 13/330,546

(22) Filed: Dec. 19, 2011

(65) Prior Publication Data

US 2012/0304973 A1 Dec. 6, 2012

(30) Foreign Application Priority Data

Jun. 1, 2011 (DE) ..... 10 2011 103 180

(51) Int. Cl.
*F02B 25/00* (2006.01)

(52) U.S. Cl.
USPC ..... 123/65 PD; 123/73 R

(58) Field of Classification Search
USPC ..... 123/73 R, 65 PD
See application file for complete search history.

(56) References Cited

U.S. PATENT DOCUMENTS 2,756,731 A * 7/1956 Wille ..... 123/65 PD
4,873,946 A * 10/1989 Masuda et al. ..... 123/65 PD
2009/0114172 A1 5/2009 Amann et al.

* cited by examiner

*Primary Examiner* — Noah Kamen
(74) *Attorney, Agent, or Firm* — Walter Ottesen P.A.

(57) ABSTRACT

An engine has a cylinder wherein a reciprocating piston is mounted. The piston drives, via a connecting rod (6), a crankshaft (7) pivotably mounted in a crankcase. The connecting rod is connected to the piston via a piston pin. An inlet window for combustion air is provided and controlled by the piston. The piston separates a combustion chamber from the crankcase interior space and has a piston base the underside of which is oriented toward the crankcase. To achieve good cooling of the piston and of the piston pin bearing, a first flow-guide element is provided within the crankcase interior space adjacent to the inlet window. The first flow-guide element redirects the combustion air flowing in through the inlet window in the direction of the underside of the piston base.

20 Claims, 12 Drawing Sheets

Fig. 1
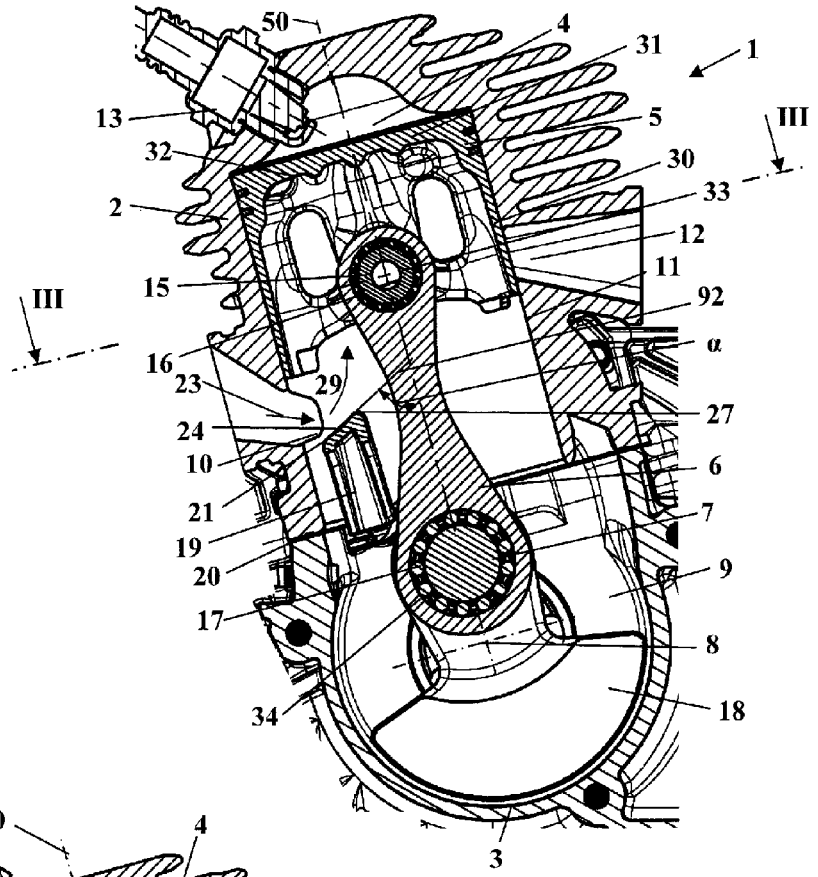
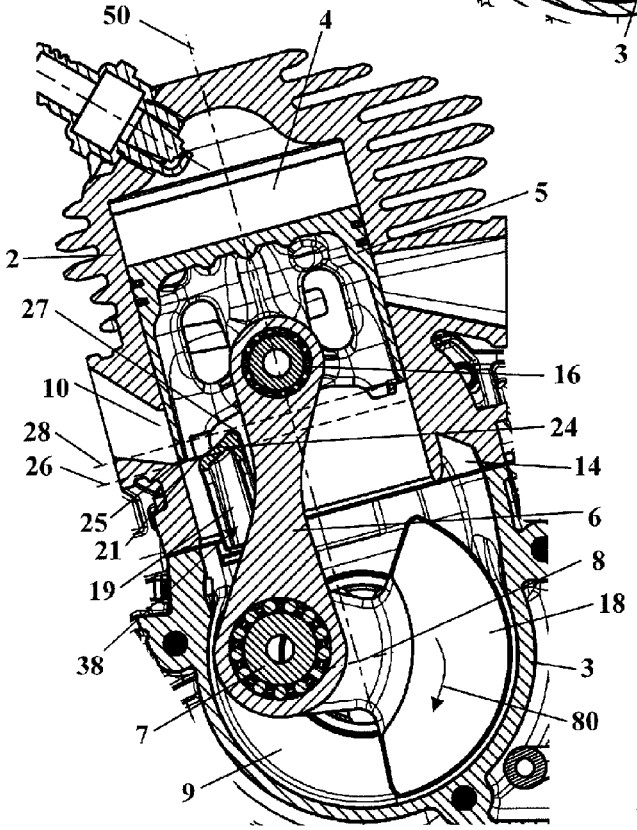
Fig. 2

TWO-STROKE ENGINE

CROSS REFERENCE TO RELATED APPLICATION

This application claims priority of German patent application no. 10 2011 103 180.8, filed Jun. 1, 2011, the entire content of which is incorporated herein by reference.

FIELD OF THE INVENTION

Disclosed herein is a two-stroke engine that comprises a flow-guide element for redirecting combustion air.

BACKGROUND OF THE INVENTION

Two-stroke engines of this kind are generally known. United States patent application publication 2009/0114172 A1, for example, discloses a two-stroke engine having a corresponding design. To achieve satisfactory cooling of the piston, the patent publication suggests arranging a flow-guide element such that it projects into the interior space of the crankcase and is oriented in the opposite direction to the rotation direction of the crankshaft. As a result, mixture from the crankcase is guided against the underside of the piston and in a direction toward the piston pin and thus cools the piston, the piston pin and the piston pin bearing.

SUMMARY OF THE INVENTION

It is an object of the invention to provide a two-stroke engine of the generic kind that achieves improved cooling of the piston and the piston pin.

The two-stroke engine of the invention includes: a cylinder defining a longitudinal axis; a crankcase connected to the cylinder and defining a crankcase interior space; a crankshaft rotatably mounted in the crankcase to rotate about a rotational axis; a piston arranged in the cylinder so as to undergo reciprocating movement along the axis; a connecting rod; a piston pin for connecting the connecting rod to the piston; the piston driving the crankshaft via the connecting rod; an inlet window for supplying combustion air to the crankcase interior space and the inlet window being controlled by the piston during the movement thereof; the piston and the cylinder conjointly defining a combustion chamber and the piston separating the combustion chamber from the crankcase interior space; the piston having a piston base defining an underside facing toward the crankcase; at least one transfer channel via which the combustion air flows from the crankcase interior space into the combustion chamber; and, a flow-guide element arranged adjacent the inlet window in the crankcase interior space for directing combustion air inflowing through the inlet window in a direction toward the underside of the piston base.

Due to the fact that the combustion air entering through the inlet is directly guided by the first flow-guide element to the underside of the piston base, the piston base and the piston pin, which is also provided in this direction, can be cooled with very cool air. Preferably, the incoming combustion air additionally comprises fuel and lubricating oil, which further increases the cooling effect. The combustion air entering through the inlet is substantially cooler than the mixture in the crankcase, such that an improved cooling of the piston pin and the piston can be achieved.

Preferably, the piston comprises a piston skirt that surrounds the piston interior space at least partially, wherein the first flow-guide element projects into the piston interior space when the piston is at bottom dead center. As a result, a small construction space of the two-stroke engine can be achieved and the flow-guide element can be provided immediately adjacent to the inlet. The width of the incident flow surface of the flow-guide element preferably corresponds to at least about 15% of the width of the inlet window, as measured parallel to the rotational axis of the crankshaft. As a result, a part of the inflowing combustion air is directed towards the underside of the piston base. The width of an element is in this case always the maximum width in each case. The width of the incident flow surface is expediently at least about 25%, more preferably at least about 50%, advantageously at least about 75%, and particularly advantageously at least about 100% of the width of the inlet. The width of the incident flow surface is advantageously as large as possible, in order that as much combustion air as possible is directed directly to the piston. The possible width of the incident flow surface is in this case limited by the available interior space within the piston.

Preferably, the connecting rod has an upper connecting rod eye that encloses the piston pin. The width of the incident flow surface of the first flow-guide element, measured parallel to the rotational axis of the crankshaft, corresponds preferably to at least about 80% of the thickness of the upper connecting rod eye, as measured parallel to the rotational axis of the crankshaft. The thickness in this case indicates the maximum thickness, that is, the maximum extension in the direction of the rotational axis of the crankcase. Preferably, the width of the incident flow surface is greater than the thickness of the connecting rod. As a result, the piston pin bearing is cooled well over its entire width.

To achieve a small construction space of the two-stroke engine while providing an incident flow surface which is as large as possible, it is provided that the first flow-guide element has a cutout into which the connecting rod plunges during rotation of the crankshaft.

Advantageously, a second flow-guide element is provided at that side of the outlet from the combustion chamber which faces toward the crankcase, and adjacent to the crankcase-facing rim of the piston skirt at bottom dead center of the piston. The second flow-guide element is in this case advantageously arranged counter to the rotational direction of the crankshaft and adjacent to the pitch circle of the crankwebs, and guides mixture from the crankcase in the direction of the underside of the piston base and the piston pin, in particular the piston pin bearing. The combination of the first flow-guide element and the second flow-guide element achieves very good cooling of piston base and piston pin because combustion air, or mixture, is directed towards the piston base and piston pin from the inlet side and from the opposite outlet side.

Advantageously, the crankcase interior space is divided by a partition element into a first region into which the inlet opens and in which the first flow-guide element is arranged, and a second region in which the crankshaft rotates, wherein the transfer channel leads into the second region. Combustion air flowing in through the inlet is initially guided by the flow-guide element towards the piston underside. During the downstroke of the piston, the combustion air is pushed from the first region into the second region. The partition impedes the transfer from the first region to the second region, thereby ensuring that the combustion air flowing in through the inlet initially reaches the piston base and the piston pin and cannot flow directly into the second region. Due to the fact that the transfer channels lead into the second region, the combustion air has to flow from the first region into the second region before being able to enter the combustion chamber through the transfer channels. As a result, a good gas circulation is achieved.

Advantageously, the first region and the second region are connected together via a passage opening. Advantageously, the passage opening is formed as small as possible. The free flow cross-section of the passage opening is advantageously smaller than about 200% of the flow cross-section of the inlet window at bottom dead center of the piston. Particularly advantageously, the free flow cross-section is less than about 150%, even more preferably less than about 120% of the flow cross-section of the inlet window. Advantageously, the free flow cross-section of the passage opening at bottom dead center of the piston is about the same as the flow-cross section of the inlet window. In this case, it is provided that the connecting rod projects through the passage opening and only a very narrow gap remains between the connecting rod and the border of the passage opening for combustion air to pass from the first region to the second region. This achieves good cooling of the stroke pin bearing. If the inflowing combustion air contains fuel, the stroke pin bearing is simultaneously lubricated well. Advantageously, the upper connecting rod eye is arranged in the vicinity of the passage opening at bottom dead center of the piston; thus, the free flow cross-section of the passage opening is computed as the area of the passage opening less the cross-sectional area of the upper connecting rod eye within the passage opening.

A simple construction results if at least one flow-guide element is arranged at the partition element. The flow-guide element and partition element are advantageously formed as one component, which results in a small number of individual parts. It can also be provided that the partition element in particular including the flow-guide element is integrally formed with the crankcase. To achieve a simple ejection of the crankcase during the injection-molding process, it is advantageously provided that the crankcase is formed from two crankcase halves, which are located in a plane parallel to the longitudinal axis of the cylinder and adjoin perpendicularly to the rotational axis of the crankshaft. However, it may also be advantageous for the partition element to be provided as a separate component, which is located in the region of the partition plane between the crankcase and the cylinder.

To increase the precompression of the mixture within the crankcase, it is advantageously provided that the partition element is formed as a filler that largely occupies the first region at bottom dead center of the piston. To achieve a low weight of the two-stroke engine in spite of the large volume of the filler, it is advantageously provided that the filler is hollow. In particular, the filler is formed with thin walls. Expediently, the partition element has an outlet-near filler element and two overflow-near filler elements, wherein the overflow-near filler elements are arranged in peripheral direction between the outlet-near filler element and the first flow-guide element. Also, the flow-guide element is in this case advantageously formed as a filler.

Advantageously, an annular gap is formed between the partition element and the cylinder wall with the piston skirt dipping, at bottom dead center of the piston, into the annular gap. The annular gap is in this case formed to maximize sealing. Since the piston has to displace the volume in the annular gap during the downstroke of the piston and correspondingly combustion air and fuel is taken in during the upstroke of the piston, the annular gap is flushed well, which results in good lubrication of the cylinder wall in this region. The choice of an annular gap ensures a high gas circulation between the partition element and the cylinder wall.

Advantageously, the flow-guide element consists only of the elements required for its function. To achieve a low weight of the flow-guide element, it is advantageously provided that the flow-guide element is formed with thin walls and comprises an incident flow surface and at least one incident flow surface positioning element. In particular, two arms positioning the incident flow surface are provided. Advantageously, the flow-guide element consists exclusively of the incident flow surface and the incident flow surface positioning elements. It may also be provided for the flow-guide element to be formed with thin walls and for further elements to be integrated in the flow-guide element. The wall thickness of the flow-guide element is advantageously less than about 5 mm, in particular less than about 2 mm, particularly advantageously less than about 2 mm, to achieve a thin-walled construction. Advantageously, the cylinder and the crankcase are separated by a partition plane. It is provided that the flow-guide element is fixed adjacent to the partition plane. In this case, the flow-guide element can be secured, from the partition plane, to the cylinder or to the crankcase, for example with fastening bolts. However, the flow-guide element can also be held within the partition plane between the cylinder and the crankcase.

The incident flow surface of the flow-guide element has an upper edge, which is oriented towards the piston base and at which the gas flow separates from the flow-guide element. Advantageously, the upper edge of the incident flow surface runs in a straight line. However, it may also be advantageous for the upper edge of the incident flow surface to be concave. The upper edge of the incident flow surface is accordingly curved in the direction of the longitudinal axis of the cylinder. The curvature of the upper edge of the incident flow surface runs in the opposite direction to the curvature of the outer side of the piston. Advantageously, the incident flow surface has a concave curvature in at least one direction. Advantageously, the incident flow surface runs in a section plane that includes the longitudinal axis of the cylinder and is concave in a section plane perpendicular thereto that intersects the longitudinal axis of the cylinder. As a result, a good incident flow towards the piston base and the piston pin eye is achieved.

BRIEF DESCRIPTION OF THE DRAWINGS

The invention will now be described with reference to the drawings wherein:

FIG. 1 shows a section through a first exemplary embodiment of a two-stroke engine with the piston at top dead center;

FIG. 2 shows the section view from FIG. 1 with the piston in an intermediate position;

DESCRIPTION OF THE PREFERRED EMBODIMENTS OF THE INVENTION

Figure 3:
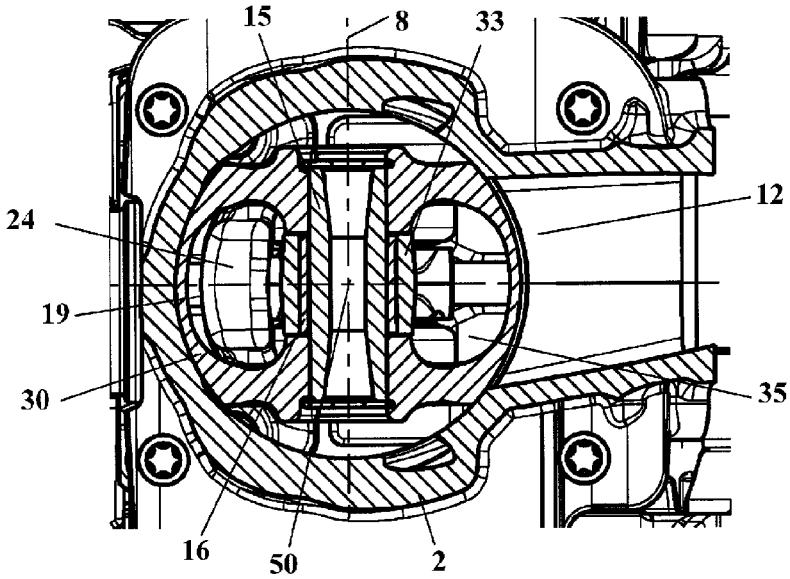
FIG. 3 shows a section along the line in FIG. 1.

FIG. 1 shows a two-stroke engine 1, which is formed as a single-cylinder motor, and which may be used for example as a drive motor in a handheld work apparatus, such as a chain saw, a cutoff machine, a brushcutter, or the like. The two-stroke engine 1 has a cylinder 2, in which a reciprocating piston 5 is mounted. The piston 5 drives, via a connecting rod 6, a crankshaft 7 that is rotatably mounted about a rotational axis 8 in a crankcase 3. The piston 5 delimits a combustion chamber 4 formed within the cylinder 2, a spark plug 13 projecting into the combustion chamber 4. Arranged on the cylinder wall 11 is an inlet window 10, via which combustion air is supplied in a flow direction 23. The inlet window 10 is in this case the opening of the intake channel for combustion air in the cylinder wall 11. Advantageously, the combustion air also comprises fuel and lubricant oil, such that an air/fuel mixture is supplied through inlet window 10. However, it is also possible for the fuel to be added later, for example, within the crankcase or the transfer channels, and for pure combustion air to be drawn in through the inlet window 10. On the opposite side from the inlet window 10, an outlet 12 opens on the cylinder wall 11 out of the combustion chamber 4. The inlet window 10 and the outlet 12 are slot-controlled by the piston skirt 30 of the piston 5.

The piston 5 has a piston base 31 that separates the combustion chamber 4 from the crankcase interior space 9. At its upper connecting rod eye 33, the connecting rod 6 is pivotably mounted by way of a piston pin bearing on a piston pin 15 on the piston 5. At the opposite end, the connecting rod 6 has a lower connecting rod eye 34 in which there is arranged piston pin bearing 17, through which the crankshaft 7 projects. On the side lying opposite the lower connecting rod eye 34, with respect to the rotational axis 8, crankwebs 18 are provided on the crankshaft 7.

Within crankcase interior space 9, a first flow-guide element 19 is provided adjacent to inlet window 10. The flow-guide element 19 has an incident flow surface 24. The piston base 31 has an underside 32, which delimits the crankcase interior space 9. At top dead center of the piston 5, depicted in FIG. 1, the combustion air, which preferably comprises fuel and lubricant oil, is drawn in through the inlet window 10 in flow direction 23 and redirected by the incident flow surface 24 in the flow direction 29 towards the underside of the piston base 32 and towards the piston pin 15. As a result, the piston pin bearing 16 and the piston base 31 are cooled well. At the same time, the cylinder wall 11 becomes well lubricated if the inflowing combustion air comprises fuel, because the cylinder wall 11 is likewise wetted with the inflowing fresh mixture, and the fresh mixture does not directly reach the crankshaft 7.

The incident flow surface 24 has a lower edge 21, which is located adjacent to the inlet window 10, and an upper edge 27, which is located closer to the piston base 31 than the lower edge 21. The upper edge 27 and the lower edge 21 lie, in the cross-sectional depiction in FIG. 1, on a straight line 92, which intersects the longitudinal cylinder axis 50 at an angle ($\alpha$) that measures 60° in the exemplary embodiment. Advantageously, the angle ($\alpha$) is as small as possible, such that the combustion air is directed towards the piston base 31 and towards the piston pin 15 as steeply as possible. The incident flow surface 24 has a concave curvature in the section plane depicted. As a result, a low flow resistance is achieved.

FIG. 2 shows the piston 5 in a position in which the inlet window 10 is completely closed. During the downstroke of the piston 5, the air/fuel mixture in the crankcase interior space 9 is compressed. FIG. 2 further shows the arrangement of the incident flow surface 24 adjacent to the inlet window 10. The incident flow surface 24 is arranged at the level of the lower third of the inlet window 10. The lower edge 25 of the inlet window 10 lies within an imaginary plane 26 that, in the depicted longitudinal section, also contains the lower edge 21 of the incident flow surface 24. The lower edge 21 of the incident flow surface 24 can also be located below or slightly above imaginary plane 26. The upper edge 27 of the incident flow surface 24 lies, in the depicted section plane, in an imaginary plane 28 which intersects the inlet window 10 in the lower half facing towards the crankcase 3, preferably approximately in the lower third. The planes 26 and 28 are oriented perpendicular to the longitudinal cylinder axis 50. The lower edge 25 of the inlet window 10, the lower edge 21 of the incident flow surface 24, and the upper edge 27 of the incident flow surface 24 may be curved. The stated arrangement of the lower edge 21 of the incident flow surface 24 at the same height or below the inlet window with respect to the longitudinal cylinder axis 50 refers to a section plane which lies perpendicularly to the rotational axis 8 of the crankshaft 7 and contains the longitudinal cylinder axis 50. Advantageously, the arrangement of the lower edge 21 at the level of or below the lower edge 25 of the inlet window also occurs in all section planes that are parallel to the plane containing the longitudinal cylinder axis 50. The lower edge 21 of the incident flow surface 24 is arranged in relation to the inlet window 10 such that a low flow resistance results.

As shown in FIG. 2, the flow-guide element 19 has a cutout 38 into which the connecting rod 6 projects during the downstroke of the piston. FIG. 2 further depicts the rotational direction 80 of crankshaft 7.

As shown in FIG. 3, piston skirt 30 encloses a piston interior space 35. The piston interior space 35 is not fully enclosed over the entire periphery of the piston skirt 30, but substantially at those sides of the piston 5 that are oriented towards the inlet window 10 and the outlet 12. At top dead center of the piston 5, the flow-guide element 19 is located below the piston interior space. At bottom dead center of the piston 5 (FIG. 4), the flow-guide element 19 projects into the piston interior space 35. FIG. 3 also depicts the arrangement of the upper connecting rod eye 33 with the piston pin bearing 16 and the piston pin 15, which is formed as a hollow pin.

Figure 4:
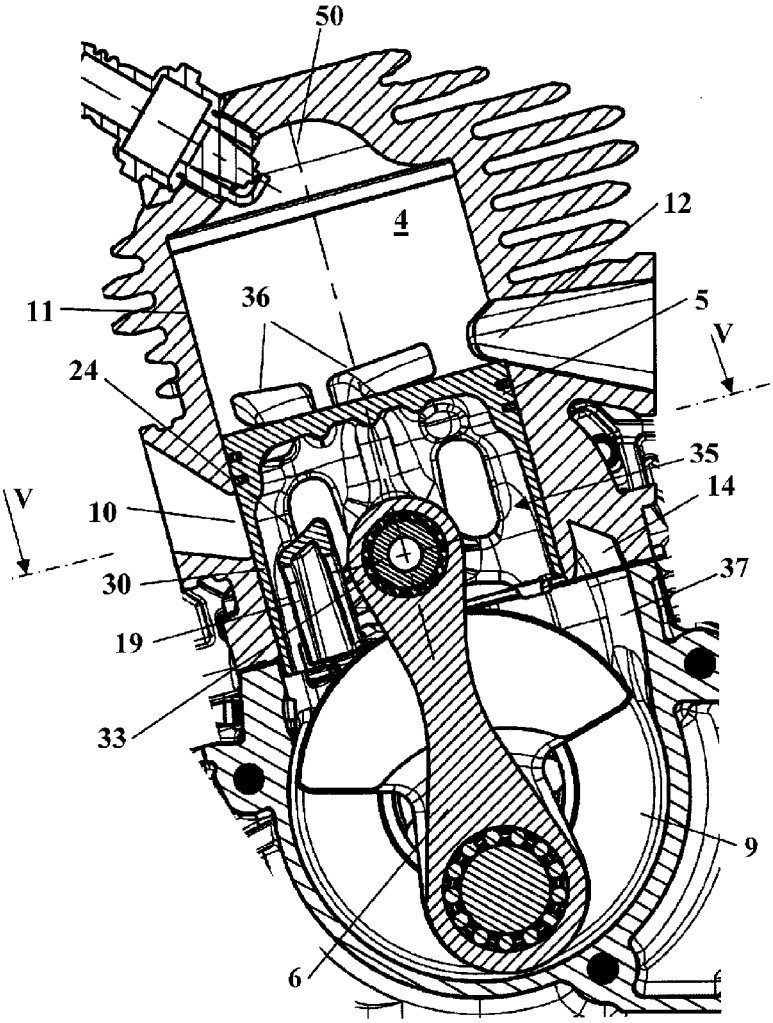
FIG. 4 shows a section view of the two-stroke engine with the piston at bottom dead center.

FIG. 4 depicts the piston 5 at bottom dead center. The flow-guide element 19 is provided completely within the piston interior space 35 and is located between piston skirt 30 and upper connecting rod eye 33.

As FIG. 4 further shows, a transfer channel 14, which connects the combustion chamber 4 at bottom dead center of the piston 5 with the crankcase interior space 9, leads, together with transfer windows 36, into the combustion chamber 4. At bottom dead center of the piston 5, the transfer windows 36 are completely open, and air/fuel mixture can flow out of the crankcase interior space 9 and into the combustion chamber 4 via the outlet opening 37, through which the transfer channel 14 opens into the crankcase 3, via the transfer channels 14, and via the transfer windows 36.

The transfer channel 14, in the exemplary embodiment, leads into the crankcase 3 via a single outlet opening 37. More than one outlet opening 37 may also be used, preferably one opening outlet 37 for each transfer channel 14. The outlet opening 37 is provided on that side of the outlet 12 facing the crankcase 3, that is, below the outlet 12. The transfer channel 14 divides into two branches in the flow direction from the crankcase 3 to the combustion chamber 4 below the outlet 12, the two branches leading helically around the cylinder 2 (FIG. 5) and opening through in each case two transfer windows 36 into the combustion chamber 4.

Figure 5:
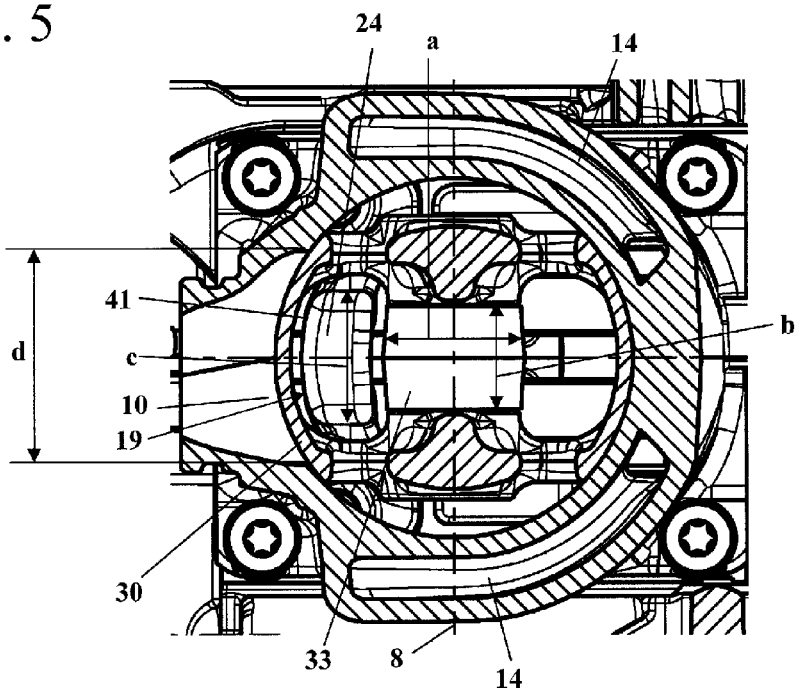
FIG. 5 shows a section along the line V-V in FIG. 4.

As shown in FIG. 5, the thickness (b) of the connecting rod eye 33, which is measured parallel to the rotational axis 8 of the crankshaft 7 and which represents the largest thickness of the connecting rod eye, is smaller than the width (c) of the incident flow surface 24, which is also measured parallel to the rotational axis 8 and which represents the maximum width of the incident flow surface 24. The width (c) may also be somewhat smaller than the thickness (b). The width (c) is advantageously at least 80% of the thickness (b), expediently at least 100%. As further shown in FIG. 5, the incident flow surface 24 extends over a majority of the width (d) of the inlet window 10. The width (d) is measured parallel to rotational axis 8 and represents the maximum width of inlet window 10. Width (c) expediently measures at least 15%, in particular at least about 25%, advantageously at least about 50%, preferably at least about 75%, particularly advantageously more than about 100% of width (d). Width (c) is advantageously as large as possible taking into account the fitting conditions.

As further shown in FIG. 5, flow-guide element 19 has a peripheral surface 41 facing the piston skirt 30, the peripheral surface 41 being curved in the exemplary embodiment, wherein the contour of the peripheral surface 41 corresponds approximately to the inner contour of piston skirt 30, such that only a narrow gap is formed between the flow-guide element 19 and the piston skirt 30. This arrangement ensures that only a small amount of air/fuel mixture can flow out of the inlet window 10 directly in the direction of the crankshaft 7. Due to the fact that the width (c) is somewhat smaller than the width (d) of the inlet window 10, a part of the combustion air can flow laterally past the flow-guide element 19 into the crankcase interior space 9. The air/fuel mixture is, however, advantageously directed towards the connecting rod eye 33 via the thickness (b) of the connecting rod eye.

Figure 6:
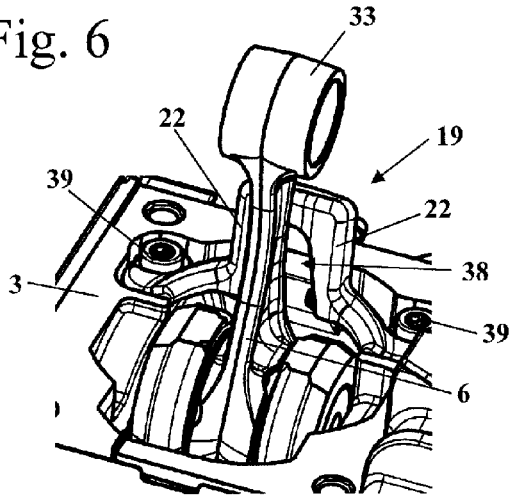
FIGS. 6 and 7 show perspective views of the crankcase of the two-stroke engine from FIGS. 1 to 5.
Figure 7:
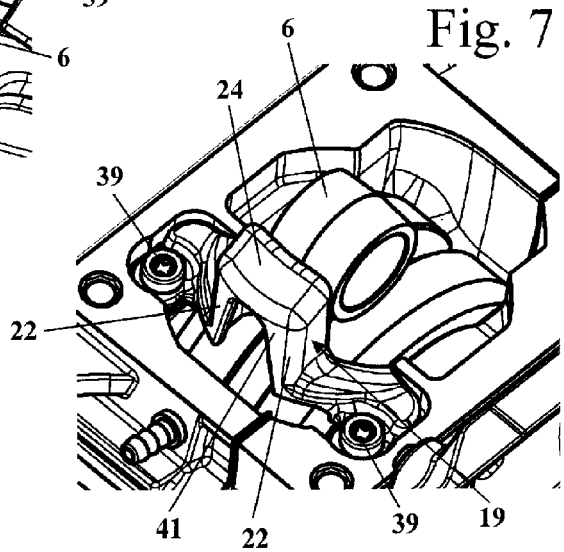

FIGS. 6 and 7 show the configuration of the first flow-guide element 19. The flow-guide element 19 has two arms 22, which lead laterally outwards and in between which the cutout 38 is formed. The two arms 22 serve to position and fix incident flow surface 24 within the crankcase interior space 9. The two arms 22 are screwed tight in the partition plane 20 (FIG. 1) between cylinder 2 and crankcase 3 by way of fastening screws 39. The flow-guide element 19 thus comprises only the elements that are necessary to position and fix incident flow surface 24. However, other means of fastening the flow-guide element 19 can also be advantageous.

Figure 8:
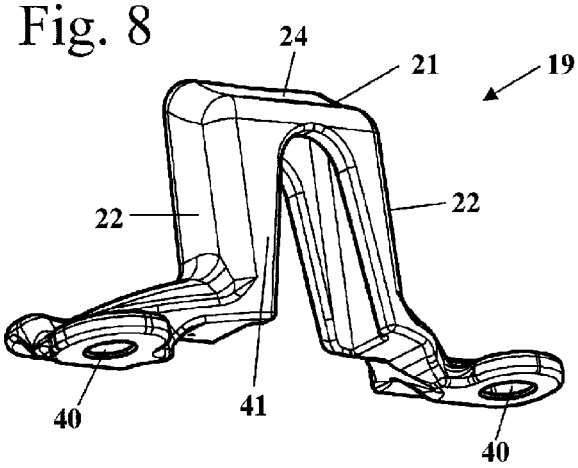
FIGS. 8 and 9 show perspective views of the flow-guide element.
Figure 9:
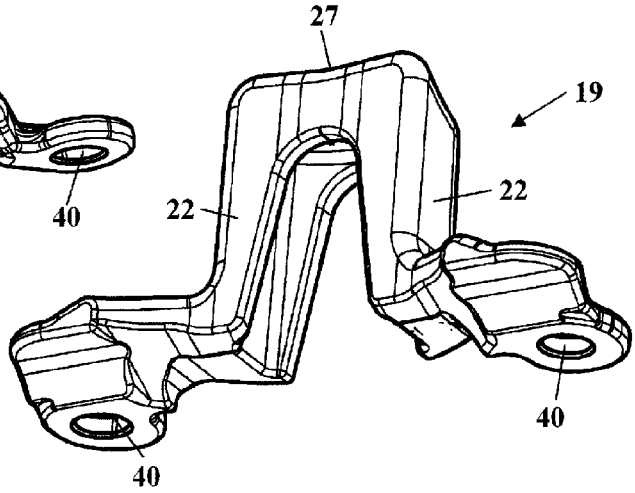
Figure 13:
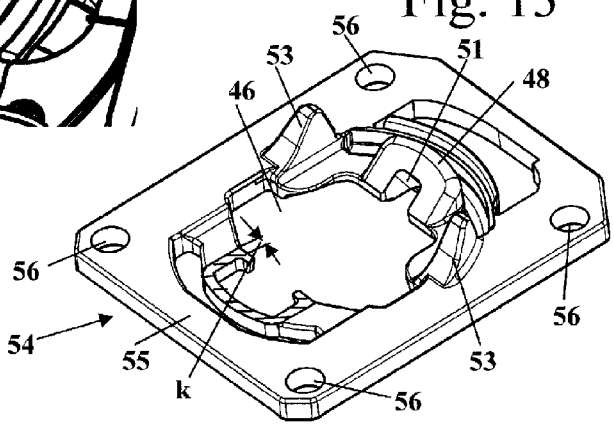
FIGS. 13 to 15 show perspective views of an exemplary embodiment of a partition element.

As shown in FIGS. 8 and 9, the first flow-guide element 19 is formed with thin walls. The wall thickness (k) of the flow-guide element 19 is shown in FIG. 13. Advantageously, the wall thickness (k) is substantially constant, such that accumulations of material are avoided. The maximum wall thickness (k) is advantageously less than about 5 mm, in particular less than about 3 mm, particularly advantageously less than about 2 mm. The two arms 22 have an approximately U-shaped cross-section to provide high stability at low weight. The peripheral surface 41 also has a cutout to reduce the weight. In order to be fixed to the crankcase 3, each arm has a respective fastening opening 40 at its end, through which the fastening screw 39 projects. The lower edge 21 and the upper edge 27 of the incident flow surface 24 do not follow a straight line, but are slightly curved. The incident flow surface follows a likewise concave curvature in the longitudinal direction of upper edge 27. Thus, incident flow surface 24 follows a concave curvature both in flow direction 29 and in the direction transverse to flow direction 29.

Figure 10:
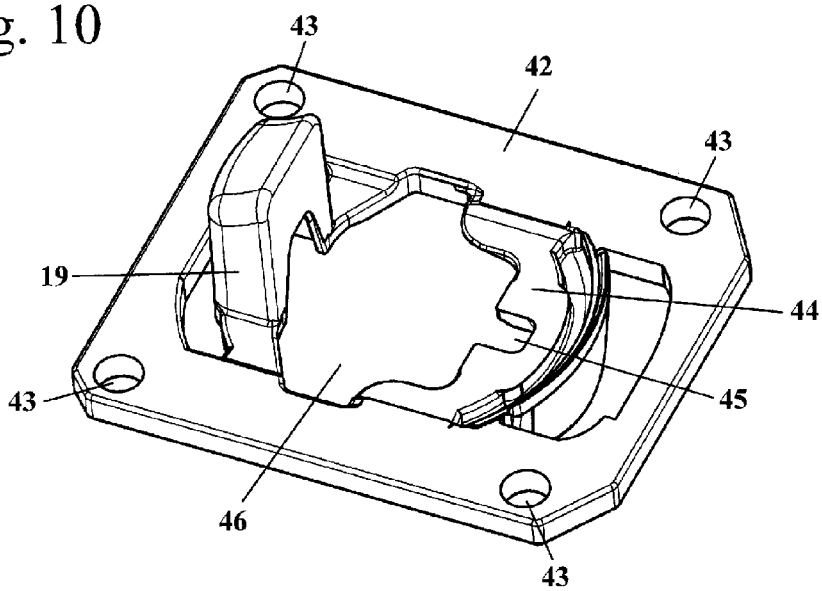
FIG. 10 shows a perspective view through an exemplary embodiment of the flow-guide element.

FIG. 10 shows an exemplary embodiment of the first flow-guide element 19 in which the first flow-guide element 19 is formed as a single piece with a partition element 42. The partition element 42 is formed essentially as a plate that has fastening openings 43 at the corners. The partition element 42 can be mounted between cylinder 2 and crankcase 3 and bolted down thereon. Opposite the first flow-guide element 19, the partition element 42 has a wall section 44 that extends between cylinder 2 and crankcase 3 and approximately parallel to partition plane 20. Wall section 44 has a cutout 45 for the connecting rod 6. Wall section 44 delimits an overflow opening 46 through which combustion air or air/fuel mixture flows from the region of piston 5 into the region of crankshaft 7. Overflow opening 46 is formed in a comparatively large manner.

Figure 11:
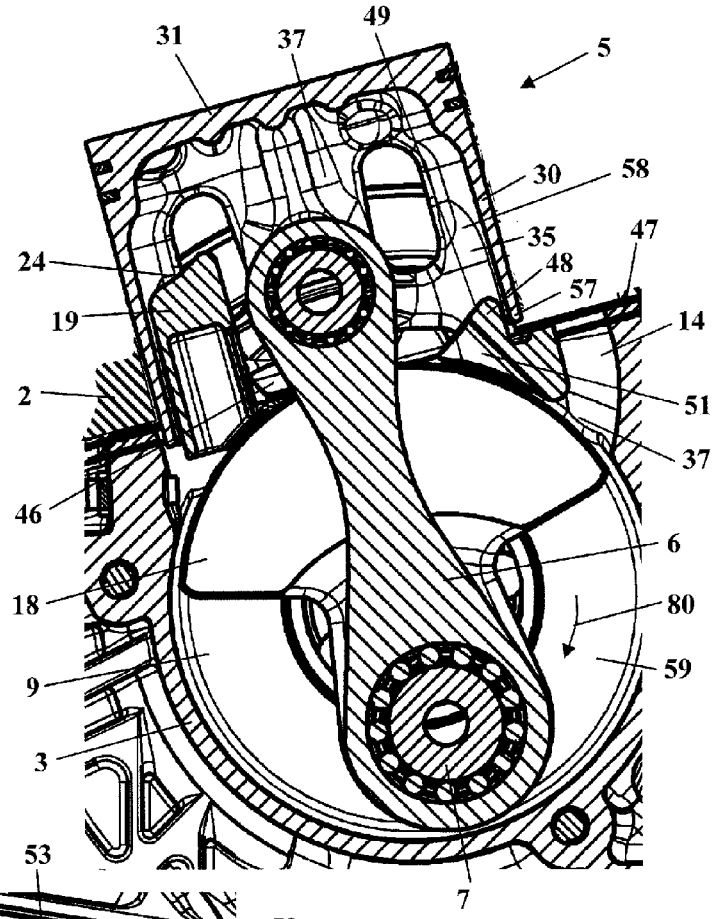
FIG. 11 shows a longitudinal section through an exemplary embodiment of a two-stroke engine wherein the cylinder is only partially depicted.
Figure 12:
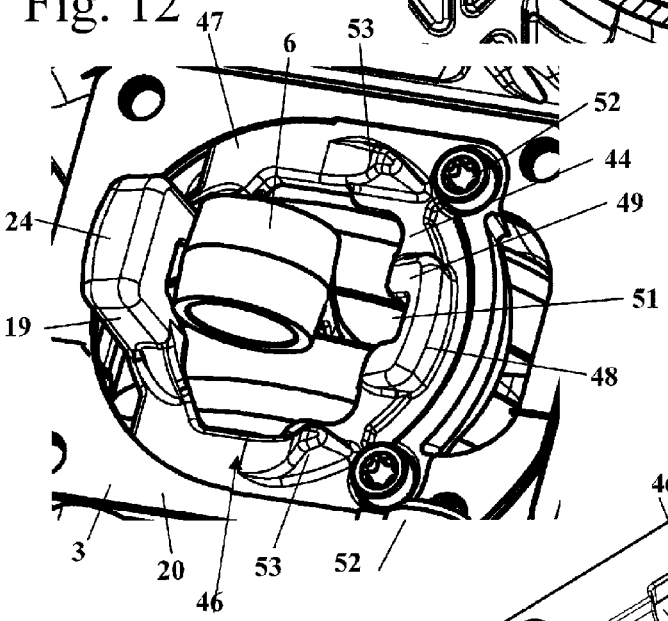
FIG. 12 shows a perspective view of the crankcase of the two-stroke engine from FIG. 11.

FIG. 11 shows a further exemplary embodiment in which the first flow-guide element 19 is formed as a single piece with partition element 47. Partition element 47, as also shown in FIG. 12, is attached to crankcase 3 with fastening screws in the region of partition plane 20 between cylinder 2 and crankcase 3. Partition element 47 has a second flow-guide element 48 that is arranged adjacent to the pitched circle of crankwebs 18, approximately at the level of the lower, crankcase-side rim 57 of piston skirt 30, and at that end of the outlet 12 which faces toward the crankcase, the outlet not being depicted in FIG. 11. Flow-guide element 48 has an incident flow surface 49, which is oriented opposite to the rotational direction 80 of crankshaft 7. As a result, the mixture conveyed with the assistance of crankwebs 18 is guided by flow-guide element 48 into the piston interior space 35. As further shown in FIG. 11, flow-guide element 48 also includes a cutout 51 for connecting rod 6.

Partition element 47 divides the piston interior space 9 into a first region 58, which is adjacent to piston 5 and opens into inlet window 10, and a second region 59, in which crankshaft 7 is arranged. These two regions 58 and 59 are connected by overflow opening 46, which is formed in the partition element 47 and corresponds to overflow opening 46 of partition element 42.

As shown in FIG. 12, the peripheral region between the first flow-guide element 19 and the second flow-guide element 48 contains side elements 53, which are located adjacent to piston skirt 30 at bottom dead center of piston 5 and which reduce the volume of first region 58. Accordingly, side elements 53 function as fillers.

Figure 14:
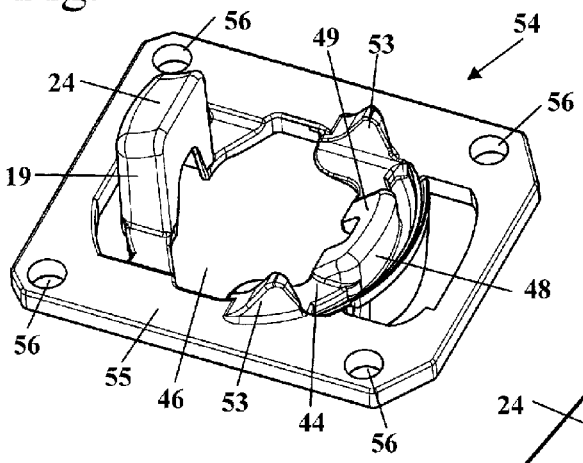
Figure 15:
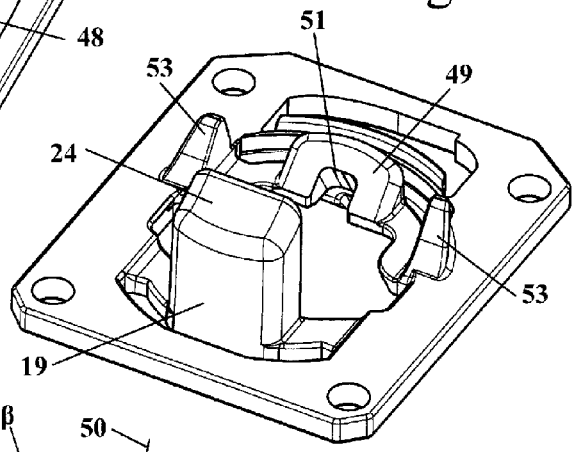

FIGS. 13 to 15 show a further exemplary embodiment of a partition element 54, which corresponds substantially to partition element 47 depicted in FIGS. 11 and 12. Partition element 54 also comprises a first flow-guide element 19 and a second flow-guide element 48, as well as side elements 53. Further, partition element 54 comprises, corresponding to partition element 42, a fastening plate 55, that contains four fastening openings 56 and is placed and fixed between cylinder 2 and crankcase 3. Partition element 54 depicted in FIGS. 13 to 15 can be formed from multiple components, in particular from two components and, as described below for exemplary embodiments according to FIGS. 22 and 23, can be formed integrally with the crankcase.

The exemplary embodiment depicted in FIGS. 16 and 17 includes a partition element 60, which is formed as a filler and substantially occupies the volume below piston 5 to increase the precompression within crankcase 3. Partition element 60 comprises a first flow-guide element 62, which includes a cutout 66 for connecting rod 6. Except for the cutout 66, the first flow-guide element 62 is solidly formed. Adjacent to outlet 12, partition element 60 has an outlet-near filler element 61. The outlet-near filler element 61 includes a cutout 67 for connecting rod 6. An annular gap 69 is formed between exterior wall 68 of partition element 60 and the cylinder wall 11, the annular gap 69 being substantially sealed towards the outside and towards the region of crankcase 3, in which the crankshaft 7 is located. As shown in FIG. 17, piston skirt 30 is completely disposed in annular gap 69 at bottom dead center of piston 5. Due to the substantial sealing of annular gap 69, the mixture contained in the annular gap 69 flows along cylinder wall 11 and along the inside of piston skirt 30 into the piston interior space 35 during the downstroke of piston 5. As a result, good lubrication of cylinder wall 11 is achieved. As further shown in FIG. 17, the outlet-near filler element 61 includes a rim 70 at the end facing away from the piston bottom 31, the rim 70 forming an annular slot of annular gap 69 and engaging around the rim of the piston skirt 30. Rim 70 extends into partition plane 20 between cylinder 2 and crankcase 3 and is sealed there by the seal provided between cylinder 2 and crankcase 3.

Figure 16:
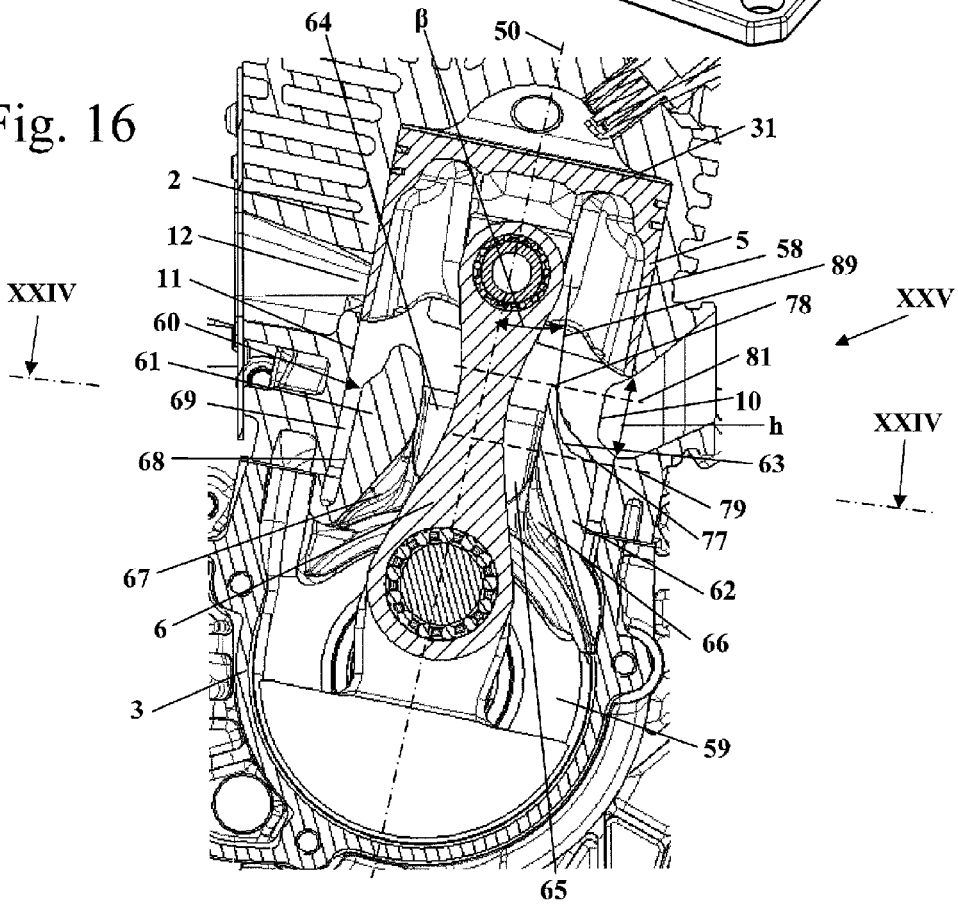
FIG. 16 shows a longitudinal section through an exemplary embodiment of a two-stroke engine with the piston at top dead center.
Figure 17:
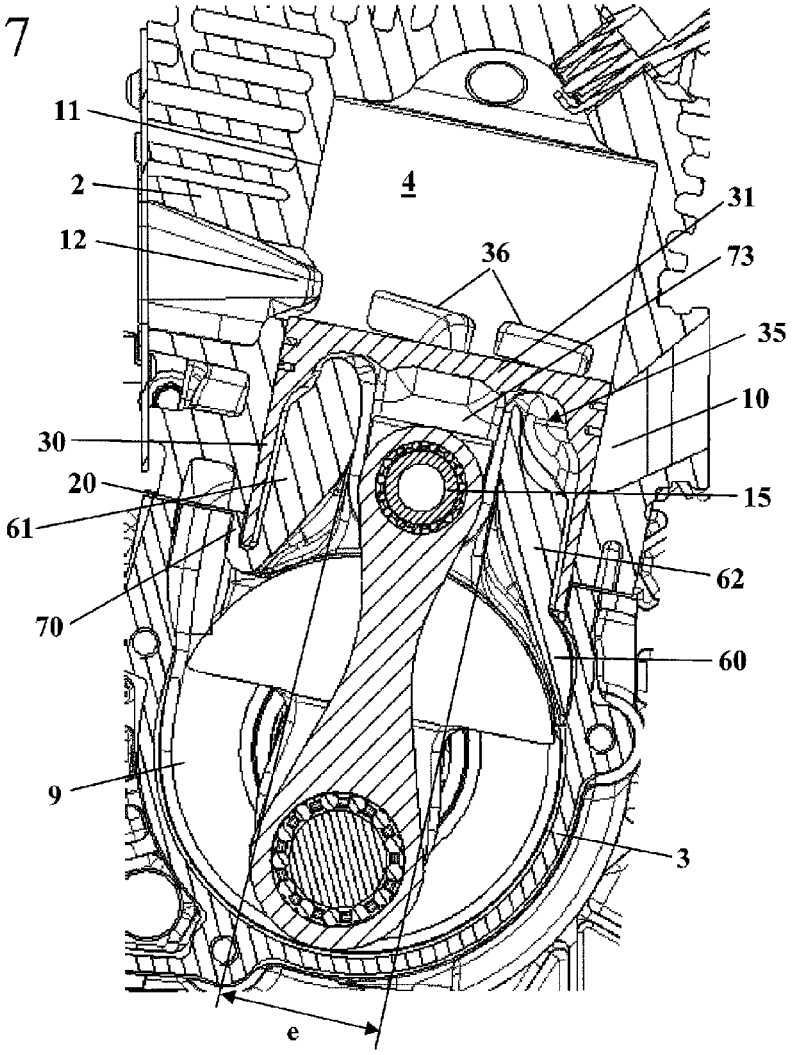
FIG. 17 shows the two-stroke engine from FIG. 16 with the piston at bottom dead center.

As shown in FIGS. 16 and 17, partition element 60 separates the first region 58 from the second region 59. Annular gap 69 is part of the first region 58 and sealed off from second region 59. The two regions are connected by a passage opening 65 through which connecting rod 6 projects. Combustion air can flow from the first region 58 into second region 59 only through passage opening 65. As further shown in FIG. 16, overflow-near filler elements 64 are arranged in the peripheral direction between outlet-near filler element 61 and the first flow-guide element 62. As depicted in FIG. 16, the first flow-guide element 62 has an incident flow surface 63, which, corresponding to incident flow surface 24, is arranged adjacent to inlet window 10.

Incident flow surface 63, in the depicted sectional direction parallel to the longitudinal cylinder axis 50, has a concave curvature. Further, incident flow surface 63 has a lower edge 77 that is located in an imaginary plane 79. Upper edge 78, facing piston base 31, of the incident flow surface 63 is located in an imaginary plane 81. The planes 79 and 81 are perpendicular to longitudinal cylinder axis 50. The incident flow surface 63, adjacent to lower edge 77, is advantageously oriented approximately tangentially to plane 79. From lower edge 77 to upper edge 78, the incident flow surface 63 has a cross-section that is approximately in the form of a quarter-circle. The tangent 89 at the upper edge 78 is very steep. Tangent 89 and the longitudinal cylinder axis form an angle (β) which is advantageously less than about 20°, and in particular less than about 10°. The plane 79 is located slightly below the inlet window 10 and plane 81 intersects inlet window 10 in its upper region in the exemplary embodiment. Plane 79 can also be located in the region of the lower edge 25 of the inlet window (FIG. 2). The arrangement of lower edge 77 at approximately the level of or below the lower edge 25 of the inlet window results in a low flow resistance. Upper edge 78 is arranged as close as possible to piston base 31 without touching the piston base 31. Arranging the upper edge 78 as close as possible to the piston base 31 provides for good flow guidance and thus cooling of piston base 31 and piston pin 15. In this exemplary embodiment, incident flow surface 63 extends over almost the entire height (h) of inlet window 10, as measured in the direction of longitudinal cylinder axis 50. The height (h) denotes in this case the largest extension of inlet window 10 parallel to longitudinal cylinder axis 50.

Figure 18:
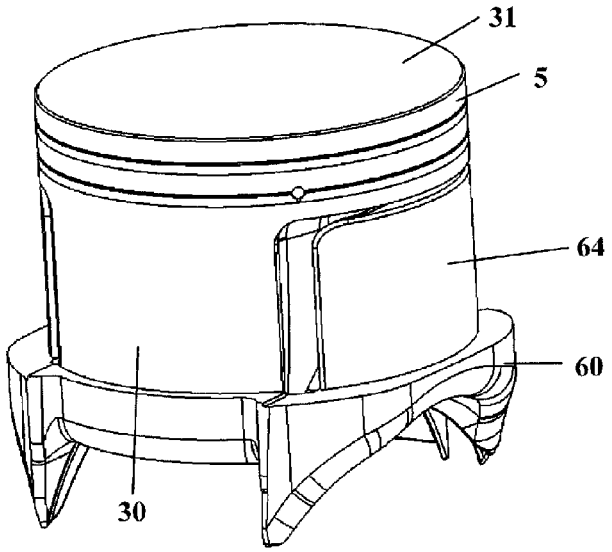
FIG. 18 shows a perspective view of the partition element from FIG. 17 with a piston.

FIG. 18 shows the arrangement of piston 5 and partition element 60 at bottom dead center of piston 5. The overflow-near filler elements 64 are arranged outside of piston interior space 35 (FIG. 17). The outer side of the overflow-near filler elements 64 is curved and forms a cylindrical surface with piston skirt 30. The outer side of the overflow-near filler elements 64 may also be located in a manner offset slightly inwards or outwards with respect to the cylindrical surface on which the outer side of piston skirt 30 is located.

Figure 19:
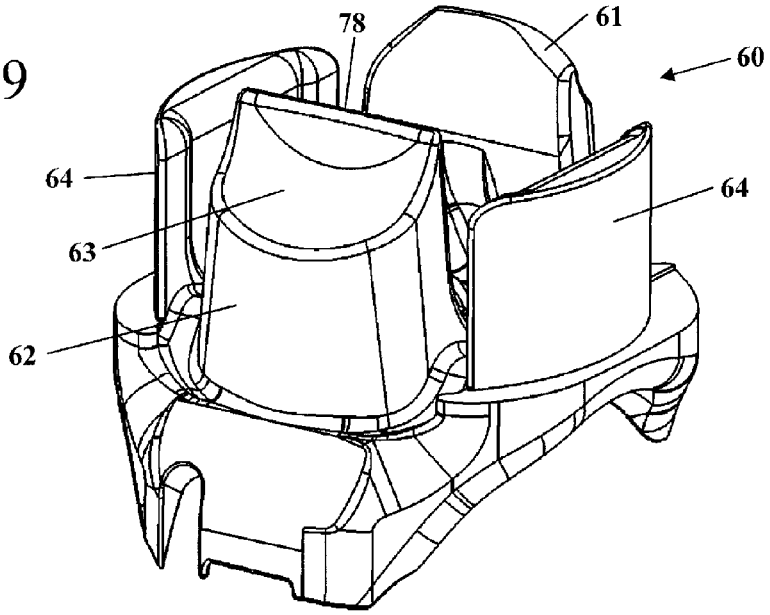
FIG. 19 shows a perspective view of the partition element of the two-stroke engine from FIGS. 16 and 17.
Figure 20:
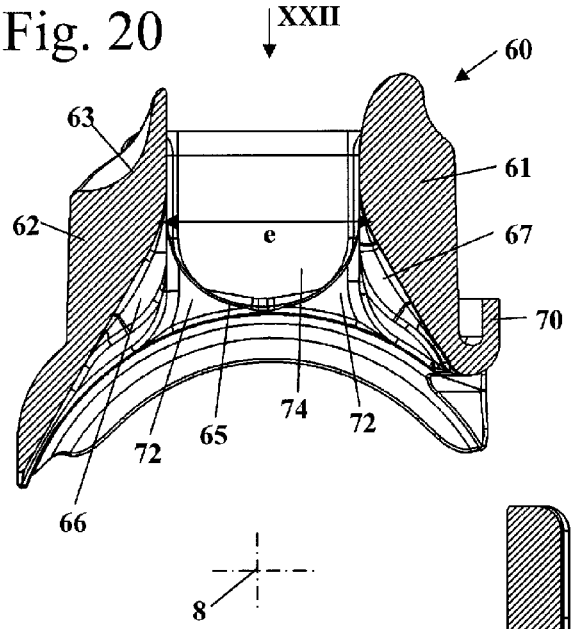
FIGS. 20 and 21 show section views through the partition element from FIG. 19.
Figure 21:
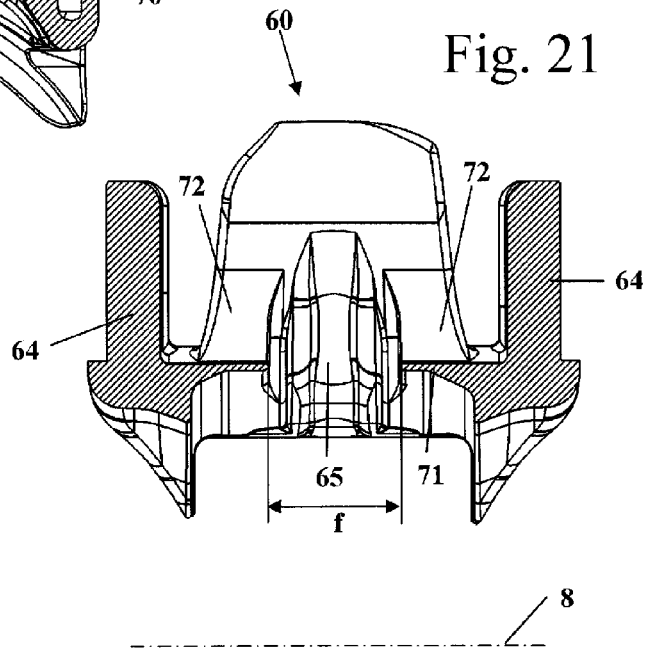
Figure 22:
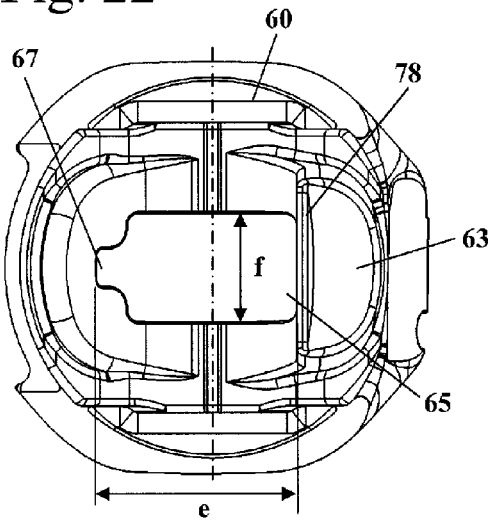
FIG. 22 shows a top view of the passage opening corresponding to arrow XXII in FIG. 20.

FIGS. 19 to 21 show the configuration of partition element 60 in detail. The overflow-near filler elements 64 substantially occupy the region between cylinder wall 11 and the outer side of piston 5. The overflow-near filler elements 64, at bottom dead center of piston 5, are located outside of the piston interior space 35 and adjacent to the struts 73 of piston 5, which are depicted in FIG. 17 and hold the piston pin 15. As depicted in FIG. 19, upper edge 78 of incident flow surface 63 forms a straight line. As shown in FIGS. 17 and 20, passage opening 65 has a length (e) measured perpendicularly to the rotational axis 8 of the crankshaft 7. The length (e) refers to the total length of the passage opening 65 including the depth of the cutout 67, which extends in the direction of longitudinal cylinder axis 50 into the area of passage opening 65. Cutout 66, too can extend into the region in which the upper connecting rod eye 33 is arranged at bottom dead center of piston 5. Length (e) and width (f) are measured at the level of the midpoint of the connecting rod eye 33 at bottom dead center of piston 5 (FIG. 17). In FIG. 21, the width (f) of passage opening 65 measured parallel to rotational axis 8 is shown. Length (e) and width (f) are also shown in FIG. 22. The outer contour of outlet-near filler element 61 corresponds to the inner contour of piston 5 in this region. Partition element 60 thus forms a filler element that substantially occupies piston interior space 35 at bottom dead center of piston 5.

Partition element 60 has dimensions such that, for given fabrication tolerances, no contact can take place between piston 5 and partition element 60 and an unhindered movement of the piston 5 in the direction of longitudinal cylinder axis 50 remains ensured.

Figure 23:
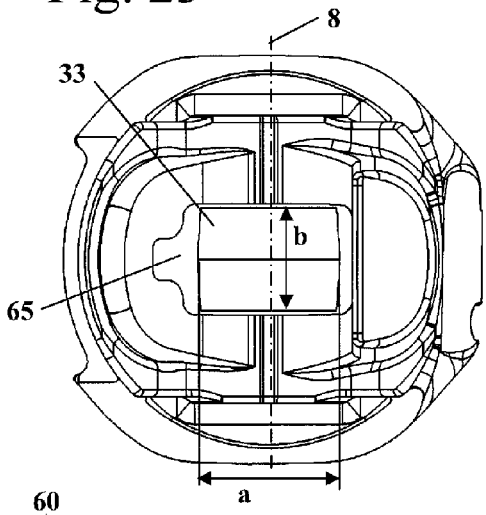
FIG. 23 shows a top view of the passage opening and the connecting rod corresponding to arrow XXII in FIG. 20.

FIG. 23 shows upper connecting rod eye 33 within passage opening 65. This position corresponds to bottom dead center of piston 5. Passage opening 65 is formed in a comparatively small manner and has dimensions such that no contact between the upper connecting rod eye 33 and the partition element 60 is possible. The free flow cross-section of passage opening 65 measures, at bottom dead center of piston 5, advantageously at most 200% of the flow cross-section of inlet window 10, in particular less than 150% of the flow cross-section of inlet window 10. Approximately identical flow cross-sections of inlet window 10 and passage opening 65 are considered to be particularly advantageous. The flow cross-section of inlet window 10 is in this case the cross-section in cylinder wall 11. The free flow cross-section of passage opening 65 results from the flow cross-section of passage opening 65 less the cross-sectional area of the upper connecting rod eye 33 within the passage opening 65. Passage opening 65 is considerably smaller than the overflow opening 46 depicted in FIG. 13. Passage opening 65 is only marginally larger than the upper connecting rod eye 33, which is arranged in the region of the passage opening 65 at bottom dead center of piston 5. Consequently, the cross-sectional area through which mixture can flow from the first region 58 into the second region 59 is very small. As a result, good lubrication and cooling of the piston and cylinder wall 11 is achieved in the first region 58. The width (a) of connecting rod eye 33 measures advantageously at least 60% of the length (e) of passage opening 65 and the thickness (b) of the upper connecting rod eye 33 measures advantageously at least 80% of the width (f) of the passage opening 65. The width (f) of passage opening 65 must be larger than the thickness (b) of the upper connecting rod eye 33 in order that the connecting rod 6 can be inserted through the passage opening 65 during assembly.

Figure 24:
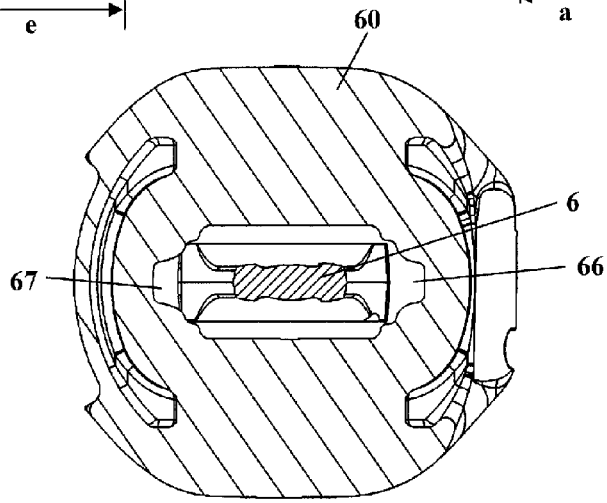
FIG. 24 shows a section along the line XXIV-XXIV in FIG. 16.

As shown in the sectional representation in FIG. 24, the cross-section of connecting rod 6 between the upper connecting rod eye 33 and the lower connecting rod eye 34 is substantially smaller than in the region of the upper connecting rod eye. The free flow cross-section in the passage opening 65 is, therefore, smallest at bottom dead center of piston 5 and increases during the upstroke of piston 5. The section depicted in FIG. 24 is located closer to the rotational axis 8 of crankshaft 7 than the upper connecting rod eye 33 at bottom dead center of piston 5. As a result, both cutouts 66 and 67 are visible in FIG. 24.

As FIGS. 20 and 21 show, a respective ramp 72 is formed next to the outlet-near filler element 61 and to the first flow-guide element 62. Ramps 72 delimit a pocket 74 into which a strut 73 (FIG. 17) of piston 5 projects. The piston pin eye holding piston pin 15 is attached to piston 5 via strut 73. The volume of the first region 58 can be minimized by ramps 72. To separate the first region 58 from the second region 59, wall section 71 depicted in FIG. 21 is provided, on which ramps 72 are disposed.

Figure 25:
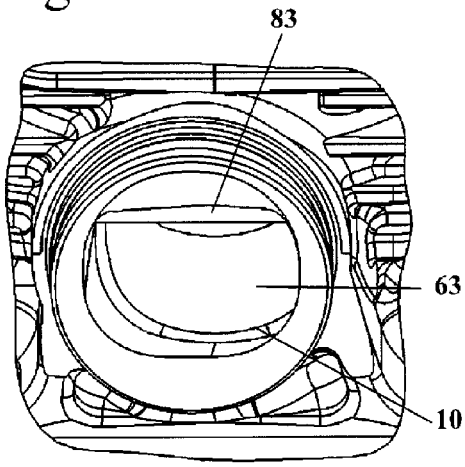
FIGS. 25 and 26 show cut-away side views of exemplary embodiments of the two-stroke engine from FIG. 16 in the direction of the arrow XXV in FIG. 16.

FIG. 25 shows a variant embodiment of partition element 60 in which the incident flow surface 63 has an upper edge 83 that is curved inwards, that is, towards the longitudinal cylinder axis 50. The incident flow surface 63 has, therefore, a concave curvature in the region of upper edge 83. Incident flow surface 63 has a concave curvature both in flow direction 29 (FIG. 1) and perpendicularly to flow direction 29. Therefore, incident flow surface 63 also has a concave curvature in a section plane perpendicular to longitudinal cylinder axis 50.

Figure 26:
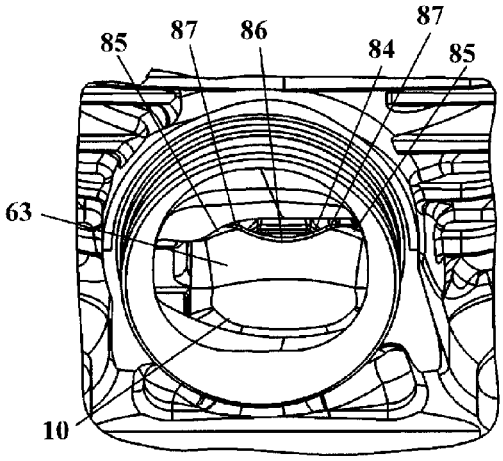

In the exemplary embodiment depicted in FIG. 26, the incident flow surface 63 has an upper edge 84, which is additionally curved in the direction of longitudinal cylinder axis 50. Upper edge 84 is slightly curved and has two side sections 85 that fall off outwardly, as well as an arched mid-section 86. Ridges or rises 87 are formed between sections 85 and 86.

Figure 27:
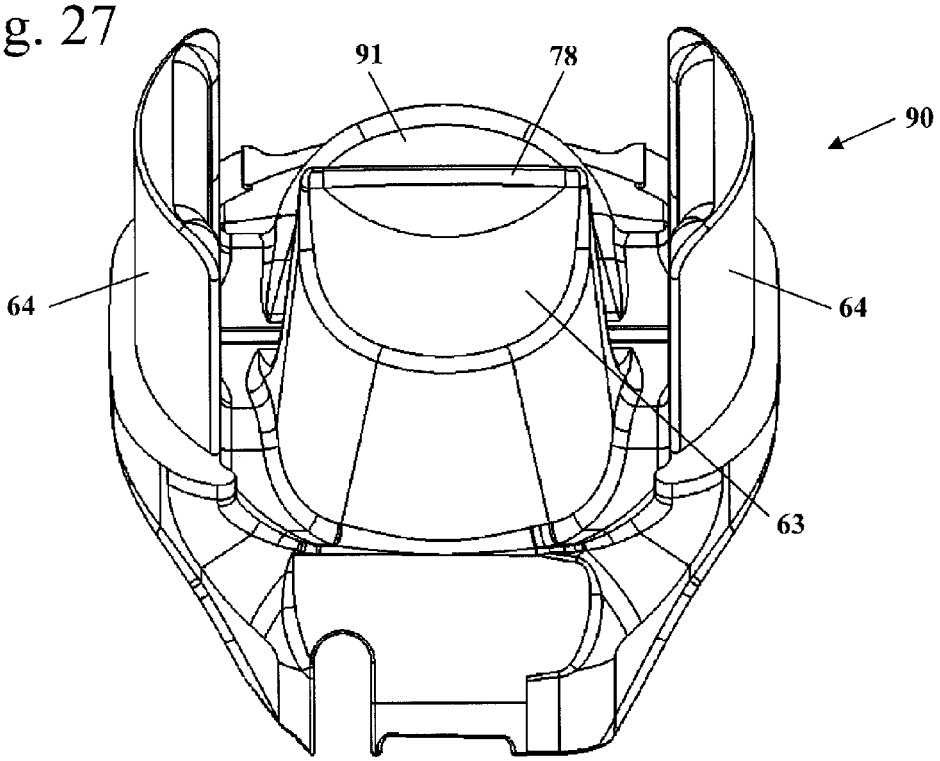
FIG. 27 shows a perspective view of an exemplary embodiment of a partition element.

FIG. 27 shows a further exemplary embodiment of a partition element 90. Partition element 90 corresponds largely to partition element 60. However, instead of the outlet-near filler element, partition element 90 is provided with a second flow-guide element 91 that corresponds approximately to the second flow-guide element 48 depicted in FIG. 11.

Figure 28:
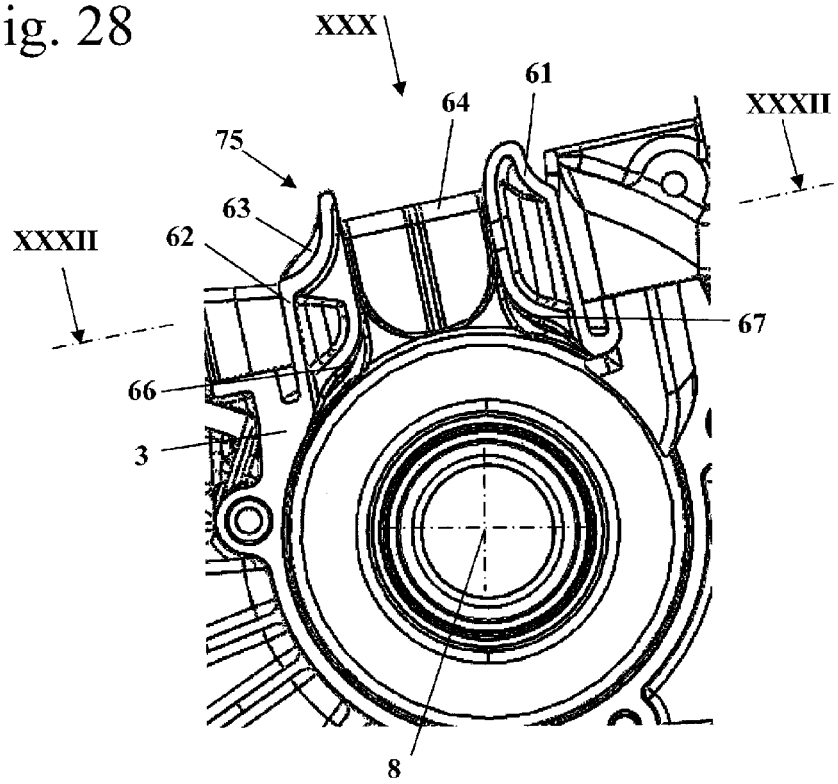
FIG. 28 shows a side view of an exemplary embodiment of the crankcase of the two-stroke engine.
Figure 29:
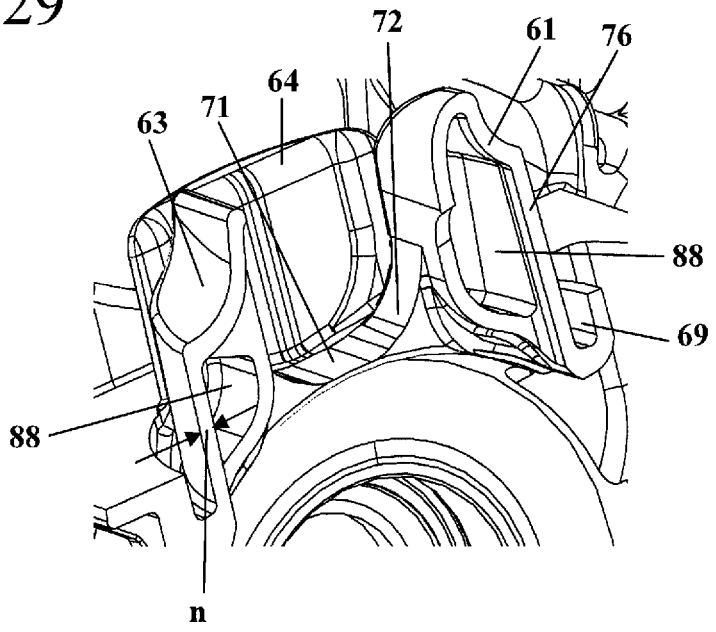
FIG. 29 shows a perspective cut-away view of the partition element of the crankcase.
Figure 30:
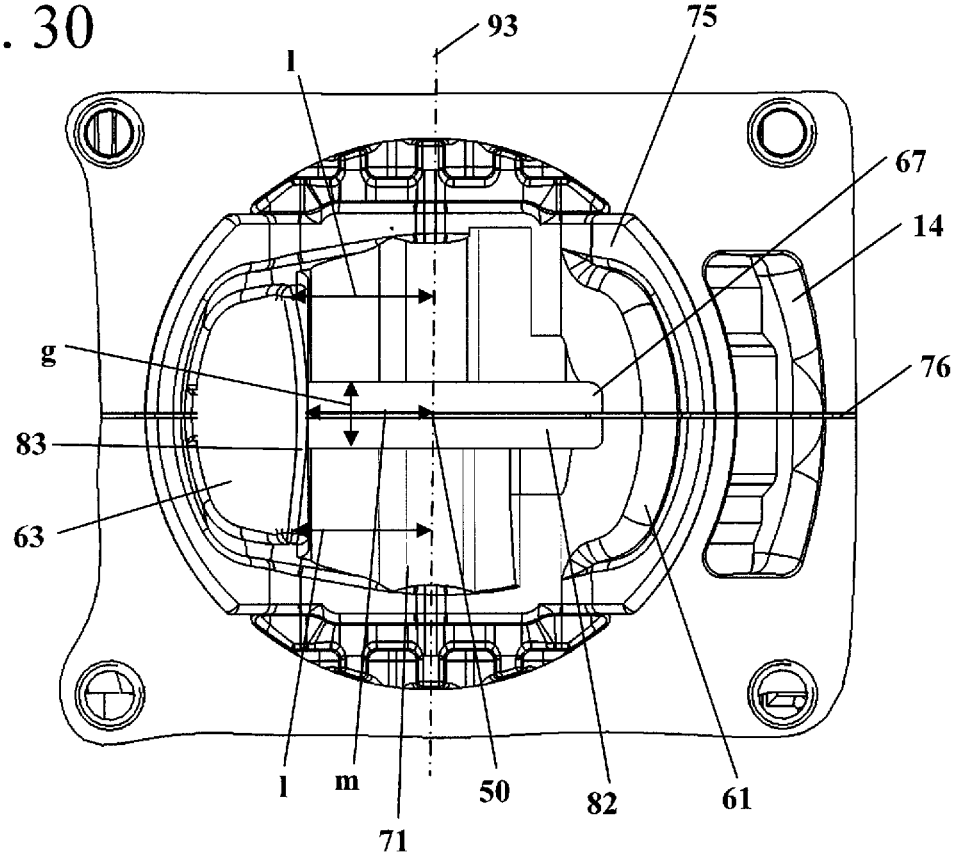
FIG. 30 shows a top view of the partition element from FIG. 28 in the direction of the arrow XXX in FIG. 28 with the crankcase closed.
Figure 31:
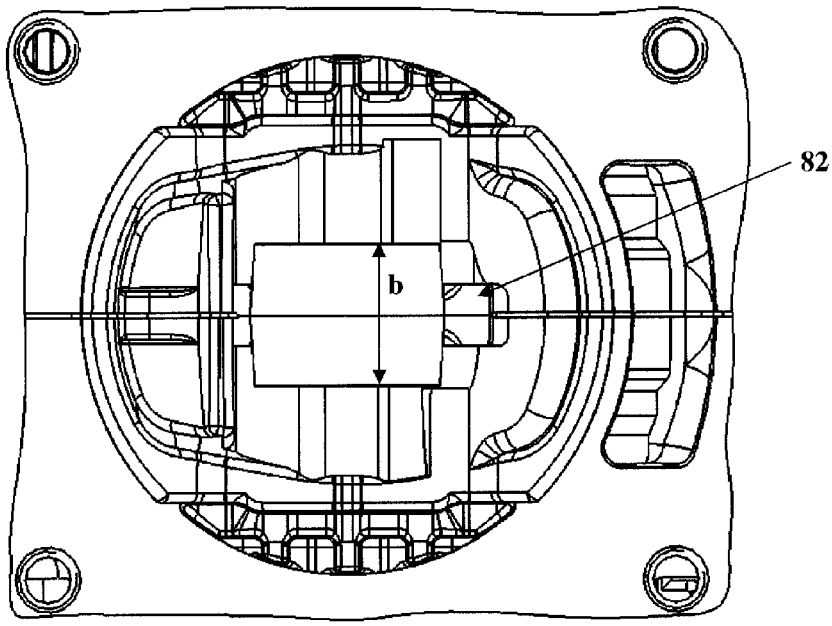
FIG. 31 shows a top view of the partition element from FIG. 30 including the connecting rod and with the piston at bottom dead center; and, FIG. 32 shows a section along the line XXXII-XXXII in FIG. 28 including the connecting rod and with the piston at top dead center.
Figure 32:
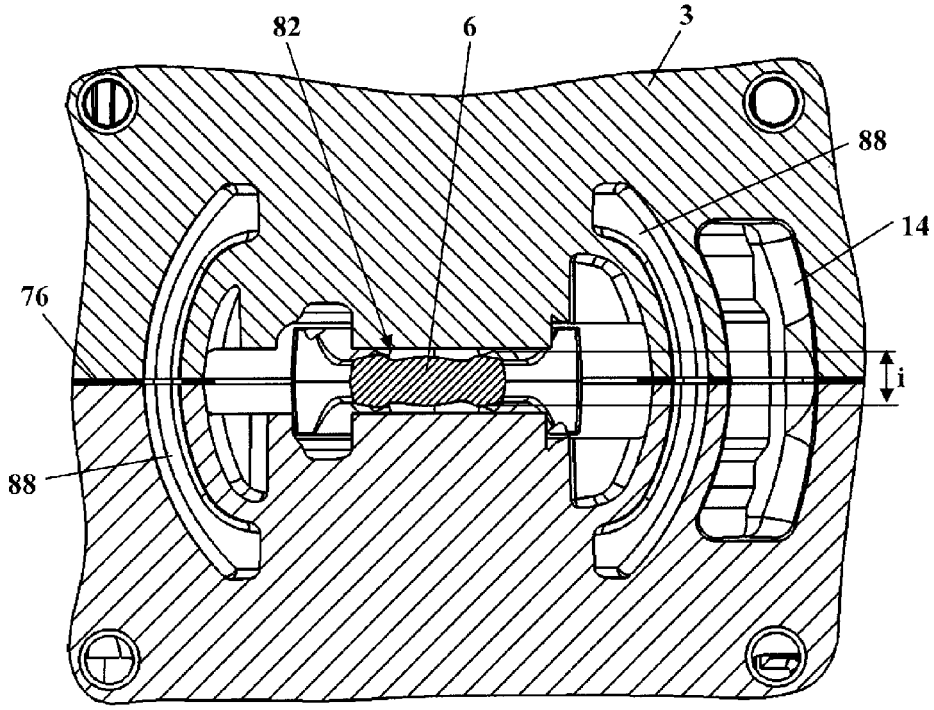

In the exemplary embodiment depicted in FIGS. 16 to 24, partition element 60 is formed as a separate element, which is held between cylinder 2 and crankcase 3. In particular for a crankcase 3 that is divided perpendicularly to the rotational axis 8 of crankshaft 7 and parallel to longitudinal cylinder axis 50, it is provided that the partition element 75 is formed on the crankcase halves, as shown in FIGS. 28 and 29. The partition plane 76 between the two halves of the crankcase 3 is depicted in FIGS. 29 and 30. As a result, a simple structure with a small number of individual elements is obtained. Partition element 75 is formed in a manner corresponding substantially to the partition element 60. The partition element 75 is formed in a hollow and thin-walled manner, which results in a low weight of the two-stroke engine 1. The wall thickness (n) of the partition element is preferably less than 5 mm, in particular less than 3 mm, particularly advantageously less than 2 mm. In particular, the wall thickness (n) is the largest wall thickness of partition element 60. The resulting cavities 88 are also depicted in the section view in FIG. 32. Furthermore, partition element 75 is designed to be easily removable from the mold during the manufacture of the crankcase 3 during the injection molding process.

As shown in FIG. 30, the incident flow surface also has a concave curvature in a plane perpendicular to the longitudinal cylinder axis. The upper edge 83 of the incident flow surface 63 is curved and has in its middle section a distance (m) to a middle plane 93 that is smaller than the distance (1) of the upper edge 83 from the middle plane 93 at the ends of the upper edge 83, that is, at the sides of incident flow surface 63. The middle plane 93 is in this case the plane that contains the longitudinal cylinder axis 50 and the rotational axis 8 of crankshaft 7. The upper edge 83 is, therefore, curved in the direction towards the longitudinal cylinder axis 50 when viewed in the direction of the longitudinal cylinder axis 50. The curvature of upper edge 83 is opposite to the curvature of piston 5 in the region adjacent to the incident flow surface 63. Incident flow surface 63 has a concave curvature in two directions, specifically in flow direction 29 (FIG. 1) and laterally with respect to the flow direction 29.

Partition element 75 has a passage opening 82, which has a width (g), as measured parallel to rotational axis 8 of crankshaft 7, that is less than the thickness (b) of the upper connecting rod eye 33 (FIG. 3). Width (g) is only marginally larger than the thickness (i), shown in FIG. 32, of connecting rod 6 in the region between the upper connecting rod eye 33 and the lower connecting rod eye 34. As a result, the free flow cross-section of passage opening 82 is very small at every position of the piston 5. Because the partition element 75 is made from two parts, connecting rod 6 may be placed between the two halves of partition element 75 during assembly and does not have to be inserted through passage opening 82. Dividing partition element 75 into two parts allows the passage opening 82 to be formed to be considerably smaller than passage opening 65.

All dimensions used herein refer to the largest dimension of the element in the stated direction.

It is understood that the foregoing description is that of the preferred embodiments of the invention and that various changes and modifications may be made thereto without departing from the spirit and scope of the invention as defined in the appended claims.

What is claimed is:

1. A two-stroke engine comprising:

a cylinder defining a longitudinal axis;

a crankcase connected to said cylinder and defining a crankcase interior space;

a crankshaft rotatably mounted in said crankcase to rotate about a rotational axis;

a piston arranged in said cylinder so as to undergo reciprocating movement along said axis;

a connecting rod;

a piston pin for connecting said connecting rod to said piston;

said piston driving said crankshaft via said connecting rod;

an inlet window for supplying combustion air to said crankcase interior space and said inlet window being controlled by said piston during the movement thereof;

said piston and said cylinder conjointly defining a combustion chamber and said piston separating said combustion chamber from said crankcase interior space;

said piston having a piston base defining an underside facing toward said crankcase;

at least one transfer channel via which said combustion air flows from said crankcase interior space into said combustion chamber; and, a flow-guide element arranged adjacent said inlet window in said crankcase interior space for directing combustion air inflowing through said inlet window in a direction toward said underside of said piston base.

2. The two-stroke engine of claim 1, wherein said piston defines an interior space and has a piston skirt which at least partially encloses said interior space of said piston; and, said flow-guide element is arranged so as to be plunged into said interior space at bottom dead center of said piston.

3. The two-stroke engine of claim 1, wherein said flow-guide element defines an incident flow surface having a width (c) and said inlet window has a width (b) measured parallel to said rotational axis of said crankshaft; and, said width (c) of said incident flow surface is at least approximately 15% of said width (b) of said inlet window.

4. The two-stroke engine of claim 1, said connecting rod having an upper connecting rod eye surrounding said piston pin; said flow-guide element defining an incident flow surface having a width (c) measured parallel to said rotational axis; said upper connecting rod eye having a thickness (b) measured parallel to the rotational axis of said crankshaft; and, said width (c) of said incident flow surface being at least 80% of said thickness (b) of said upper connecting rod eye.

5. The two-stroke engine of claim 1, further comprising a crankshaft mounted in said crankcase so as to rotate about a rotational axis; and, said flow-guide element having a cutout wherein said connecting rod plunges during the rotation of said crankshaft.

6. The two-stroke engine of claim 1, said flow-guide element being a first flow-guide element and said two-stroke engine further comprising a second flow-guide element; an outlet leading out of said combustion chamber and having a side facing toward said crankcase; said skirt of said piston having a rim facing toward said crankcase; and, said second flow-guide element being mounted on said side of said outlet and adjacent said rim of said piston when said piston is at bottom dead center.

7. The two-stroke engine of claim 1, further comprising a partition element for partitioning said interior space of said crankcase into a first region wherein said inlet window opens and wherein said flow-guide element is mounted and into a second region wherein said crankshaft rotates; and, said transfer channel opening into said second region.

8. The two-stroke engine of claim 7, further comprising a passthrough opening interconnecting said first and second regions; said inlet window having a predetermined flow cross-section; and, said passthrough opening having a free flow cross-section of less than 200% of said free flow cross-section of said inlet window when said piston is at bottom dead center.

9. The two-stroke engine of claim 8, wherein said connecting rod projects through said passthrough opening.

10. The two-stroke engine of claim 7, wherein said flow-guide element is mounted on said partition element.

11. The two-stroke engine of claim 7, wherein said partition element is formed on said crankcase.

12. The two-stroke engine of claim 7, wherein said crankcase and said cylinder conjointly define a partition plane therebetween; and, said partition element is a separate component fixed in the region of said partition plane.

13. The two-stroke engine of claim 7, wherein said partition element is configured as a filler piece which substantially fills out said first region when said piston is at bottom dead center.

14. The two-stroke engine of claim 13, wherein said partition element is configured to be hollow.

15. The two-stroke engine of claim 13, wherein said partition element has an outlet-near filler element and two overflow-near filler elements; and, said overflow-near filler elements are mounted between said outlet-near filler element and said flow-guide element.

16. The two-stroke engine of claim 7, wherein said cylinder has a cylinder wall; and, said partition element and said cylinder wall conjointly define an annular gap into which said skirt of said piston plunges at bottom dead center of said piston.

17. The two-stroke engine of claim 1, wherein said flow-guide element is configured to be a thin-walled element and defines an incident flow surface and elements which position said incident flow surface.

18. The two-stroke engine of claim 1, said cylinder and said crankcase conjointly defining a partition plane separating said cylinder and said crankcase from each other; and, said flow-guide element being fixed adjacent to said partition plane.

19. The two-stroke engine of claim 1, wherein said flow-guide element has an incident flow surface defining an upper edge running in a straight line; and, said upper edge faces toward the base of said piston.

20. The two-stroke engine of claim 1, wherein said flow-guide element has an incident flow surface which runs concave in at least one direction.

* * * * *

UNITED STATES PATENT AND TRADEMARK OFFICE

CERTIFICATE OF CORRECTION

PATENT NO. : 8,671,897 B2
APPLICATION NO. : 13/330546
DATED : March 18, 2014
INVENTOR(S) : W. Geyer et al.

It is certified that error appears in the above-identified patent and that said Letters Patent is hereby corrected as shown below:

In the Specification

In Column 4:
Line 51: insert -- III-III -- after "line".

In Column 12:
Line 43: delete "distance (1)" and insert -- distance (l) -- therefor.

Signed and Sealed this
Twenty-third Day of September, 2014

Michelle K. Lee

Michelle K. Lee
*Deputy Director of the United States Patent and Trademark Office*